United States Patent [19]

Toledano

[11] Patent Number: 4,895,404

[45] Date of Patent: Jan. 23, 1990

[54] DOOR LATCH HAVING AN ADJUSTABLE BACKSET DISTANCE

[75] Inventor: Abraham Toledano, Laval, Canada

[73] Assignee: Ilco Unican Inc., Montreal, Canada

[21] Appl. No.: 289,005

[22] Filed: Dec. 20, 1988

[51] Int. Cl.[4] ..... E05C 1/16

[52] U.S. Cl. ..... 292/337; 292/DIG. 74; 292/DIG. 60

[58] Field of Search ..... 292/337, 169.15, DIG. 74, 292/DIG. 60; 70/134

[56] References Cited

U.S. PATENT DOCUMENTS

| | | | |
|---|---|---|---|
| 3,790,196 | 2/1974 | Sanders et al. | 292/DIG. 74 X |
| 4,593,542 | 6/1986 | Rotondi et al. | 70/134 |
| 4,602,490 | 7/1986 | Glass et al. | 70/134 |
| 4,615,549 | 10/1986 | Couture | 292/DIG. 74 X |
| 4,623,174 | 11/1986 | Trull et al. | 70/461 |
| 4,639,025 | 1/1987 | Fann et al. | 292/337 |
| 4,656,849 | 4/1987 | Rotondi et al. | 70/134 |

*Primary Examiner*—Richard E. Moore

*Attorney, Agent, or Firm*—Fishman, Dionne & Cantor

[57] ABSTRACT

An elongated bolt extension member is coupled to the bolt head of a door latch, and a pivotally mounted latch cam engages the elongated bolt extension member to slide the latch into and out of its retracted position. The elongated bolt extension member has a top surface with two spaced openings corresponding to two different backset distances. The latch cam extends into one or the other of the openings to adjust the backset distance.

4 Claims, 4 Drawing Sheets

DOOR LATCH HAVING AN ADJUSTABLE BACKSET DISTANCE

BACKGROUND OF INVENTION

1. Field of the Invention

The invention relates to a door latch having an adjustable backset distance. More specifically, the invention relates to such a door latch in which the backset distance can be set to one of two predetermined distances.

2. Description of Prior Art

Door latches having adjustable backset distances are known in the art as illustrated in, for example, U.S. Pat. Nos. 4,593,542, Rotondi et al., June 10, 1986, 4,602,490, Glass et al, July 29, 1986, 4,623,174, Trull et al., Nov. 18, 1986 and 4,639,025, Fann et al., Jan. 27, 1987.

In the '025 patent, to change the backset distance, it is necessary to move both extension member 20, crank plate holding means 32 and crank plate 31, relative to pivot pin 26 which then occupies one of two positions 132 of aperture 131 of extendable member 123 of bolt extension member 20.

In the '490 patent, to change the backset distance, a floating pin 45 is pushed downwardly, against the force of a spring 51, in legs 62 of slot 60 of casing 20, and legs 68 or 69 of slot 65 of driver bar 30. Driver bar 30, slide 35 (for spindle 16 and dog 27) are moved from one backset distance to another. In order to adjust the backset distance in accordance with the teachings in this patent, screws 18 must be removed from slide 35 and holes 75 and 76 in casing 20 before the adjustment can be effected.

In the '542 patent, the latch cam 56 is coupled to at least one side plate 40 (in the illustrated embodiments to side plates 40 and 41) and the side plates and latch cam are slidable within latch case 22 to adjust the distance of the backset.

The '849 patent, which is a division of the '542 patent, teaches the same arrangement.

Finally, in the '174 patent, the backset distance is adjusted by selecting one of two inserts, 40 or 40', which are different lengths.

SUMMARY OF INVENTION

In accordance with the present invention, the latch cam, which is carried in a latch cam holder arrangement, is movable with the latch cam holder arrangement, from one position to another position to adjust the backset distance. The bolt extension member has two openings in the top surface thereof. The latch cam engagement means extends through a different one of said openings when the latch cam and the latch cam holder arrangement are in their different positions.

More specifically, and in accordance with the invention, a door latch having an adjustable backset distance comprises an elongated latch housing having a first end and a second end. A bolt head is slidably mounted in the latch housing for moving into and out of the latch housing through the first end thereof. An elongated bolt extension member has one end thereof coupled to the bolt head, so that the bolt head and the bolt extension member will move together, and the other end extends out of the latch housing through the second end thereof. The bolt extension member is U-shaped in cross-section and has a top surface which forms the bridge of the U. The top surface of the bolt extension member has first and second spaced openings adjacent to the other end of the bolt extension member. A latch cam has an engagement means at one end thereof and a circular boss means at the other end thereof. An extension housing arrangement extends from the second end of the latch housing, the bolt extension member being slidably housed in the extension housing. A latch cam holder arrangement is movably housed in the extension housing to be movable from a first position, corresponding to a first backset distance, to a second position, corresponding to a second backset distance, whereby to adjust the backset distance of the door latch. In the first position, the engagement means of the latch cam extends through the first opening in the top surface of the bolt extension member, and in the second position, the engagement means of the latch cam extends through the second opening in the top surface of the bolt extension member. The latch cam is pivotally held in the latch cam holder arrangement for pivoting about the center of the circular boss means. Thus, when the latch cam is pivoted in one direction, it engages the bolt extension member and causes it to slide in the extension housing in the one direction to extend the bolt head out of the latch housing, and, when the latch cam is pivoted in the second direction, opposite to the first direction, it engages the bolt extension and causes it to slide in the extension housing arrangement in the second direction to retract the bolt head into the latch housing.

BRIEF DESCRIPTION OF DRAWINGS

The invention will be better understood by an examination of the following description, together with the accompanying drawings, in which.

DESCRIPTION OF PREFERRED EMBODIMENTS

Figure 1:
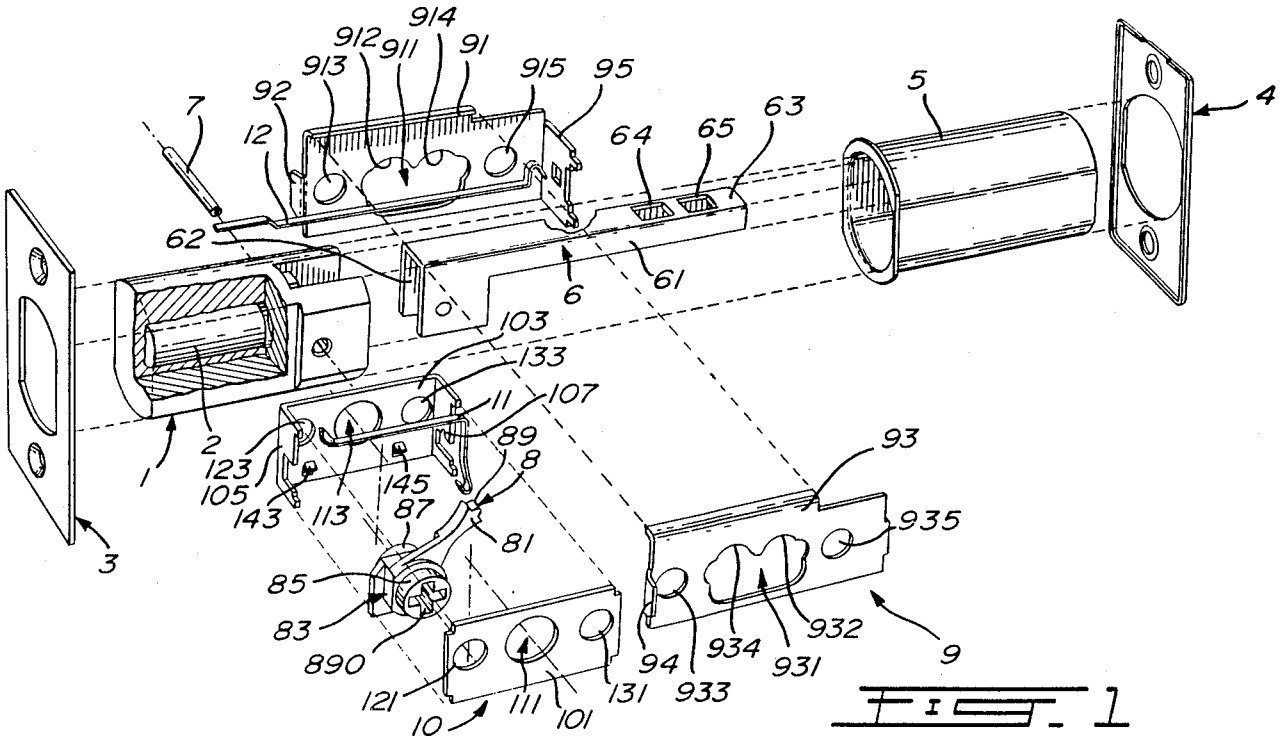
FIG. 1 is an exploded view of the inventive door latch.

Referring now to the drawings, the door latch includes a bolt head 1 having a hardened pin 2 as well known in the art. The door latch is mounted on the edge of a door and in a blind bore hole, again, as well known in the art, using a front plate 3 and a mounting plate 4.

Figure 2:
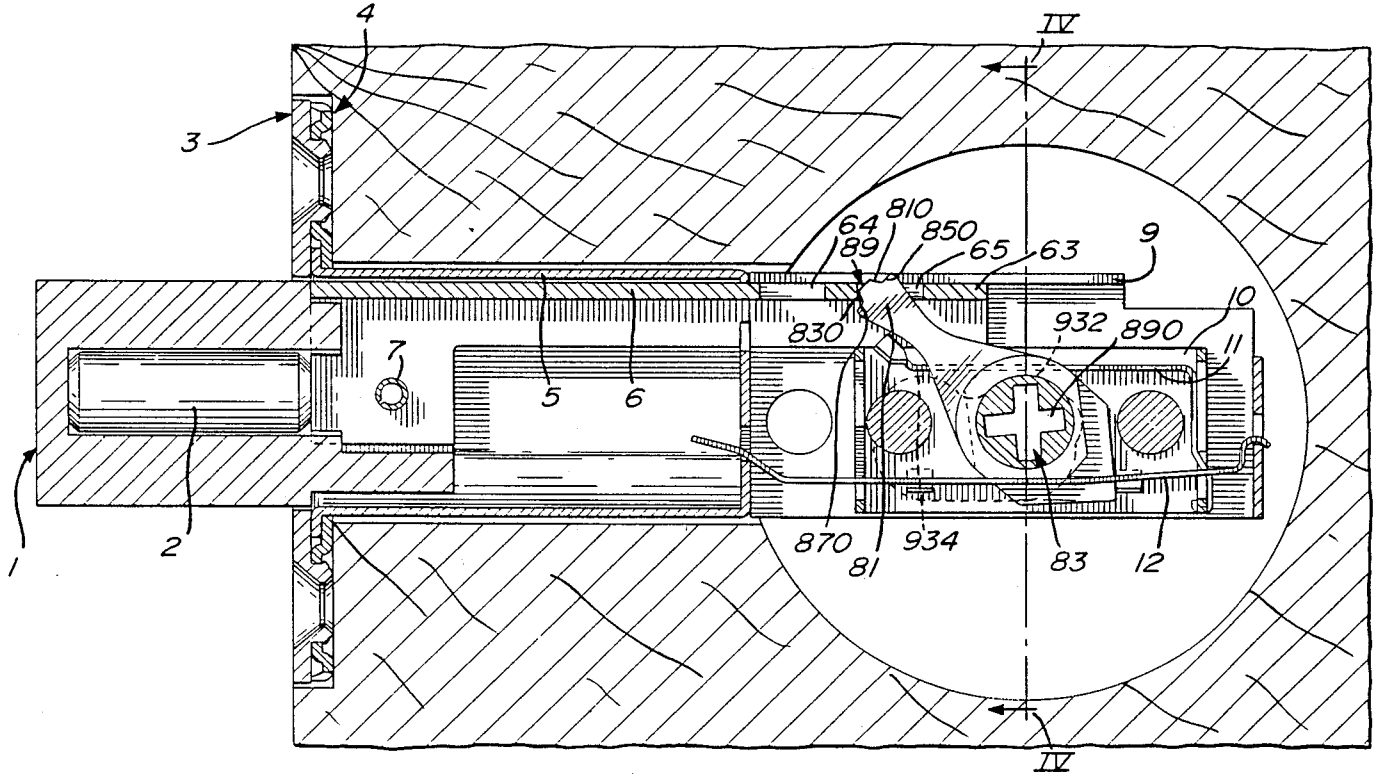
FIG. 2 is a sectional side view of the inventive door latch having a first backset distance ($2\frac{3}{4}''$)
Figure 3:
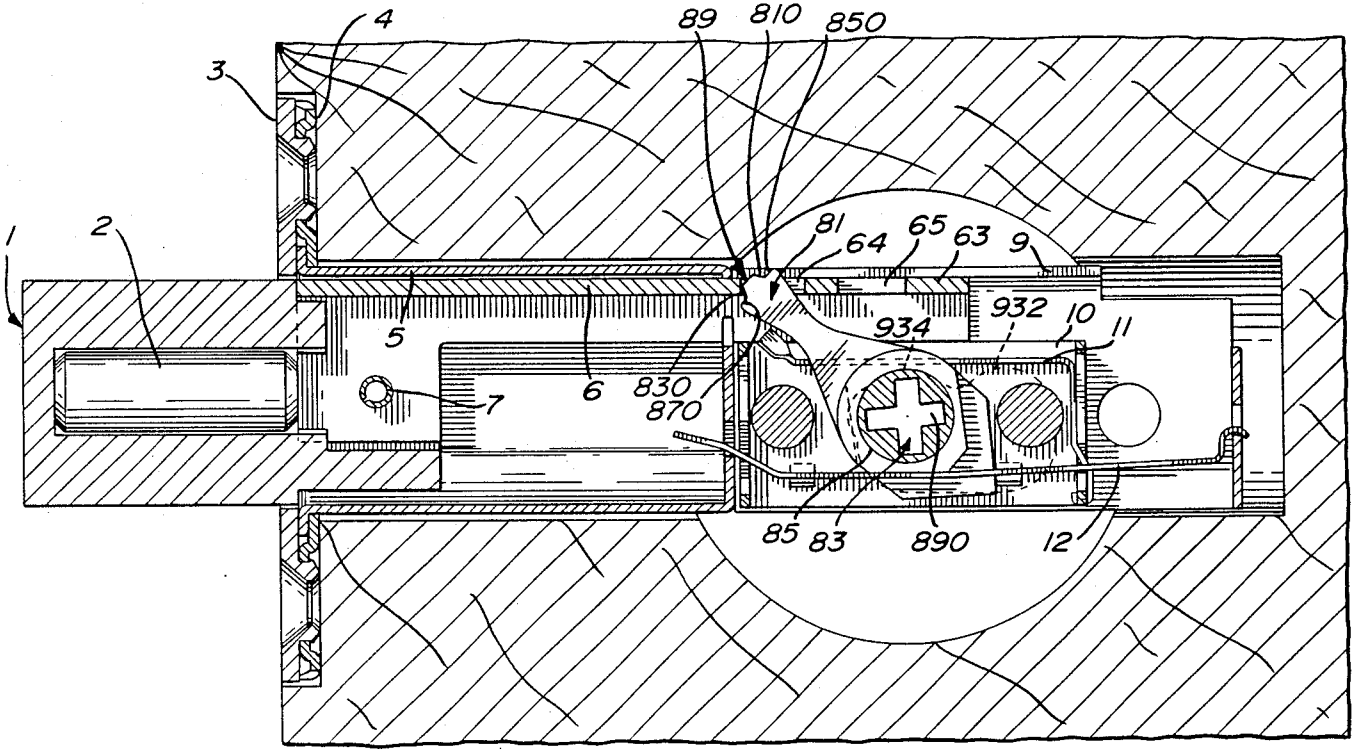
FIG. 3 is a view similar to FIG. 2 but having a second backset distance ($2\frac{3}{8}''$)
Figure 4:
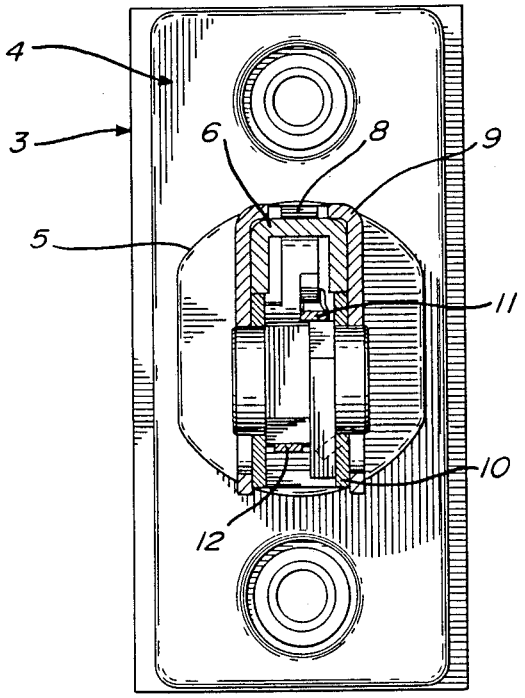
FIG. 4 is an end view through IV—IV of FIG. 2.

The bolt head 1 is mounted for sliding movement into and out of latch housing 5. In FIGS. 2 and 3, the bolt head is shown in its fully extended position. It is retractable into the latch housing 5 and, when in its retracted position, the front end of the bolt head is aligned with the front plate 3.

An elongated bolt extension member 6 is coupled, at one end thereof, to the inner end of the bolt head 1 by a rolling pin 7 such that the bolt head and the bolt extension member move together. As best seen in FIG. 1, the bolt extension member is U-shaped in cross-section and includes side walls 61 and 62 and top surface 63. Spaced openings 64 and 65 are provided in the top surface 63 of bolt extension member 6.

A latch cam 8 includes an engagement means 81 at one end thereof and a circular boss means 83 at the other end thereof. The boss means 83 comprises a circular protrusion 85 on one surface of the latch cam and an aligned circular protrusion 87 on the second surface of the latch cam (see FIG. 1). The engagement means comprises a lateral top surface 89 with lateral sloping surfaces 810 and 830 sloping downwardly from opposite edges of the lateral top surface 89. Lateral aligned surfaces 850 and 870 are parallel to lateral top surface 89 (see FIG. 2).

As seen in FIG. 1, extension housing arrangement 9 includes a first side wall 91 and a second, spaced, side wall 93, the side walls being spaced by end wall 95. First side wall 91 has a flange 92 and second side wall 93 has a flange 94. The flanges are insertable into respective openings of the latch housing.

As can be seen, side wall 91 has a cut-out 911 which includes two spaced arcs 912 and 914. The arcs are of the same radius as the radius of the protrusion 85. Screw holes 913 and 915 are disposed on either side of the cut-out 911.

In a like manner, side wall 93 has a cut-out 931 with spaced arcs 932 and 934 The cut-out 911 is aligned with the cut-out 931. The arcs 932 and 934 have the same radius as protrusion 87. Screw holes 933 and 935 are disposed on either side of the cut-out 931.

Latch cam holder arrangement 10 includes spaced side walls 101 and 103. The side walls are spaced by end walls 105 and 107 which may be made integral with side wall 101. A circular opening 111 in side wall 101 receives protrusion 85 of latch cam 8. The radius of opening 111 is somewhat larger than the radius of protrusion 85. In a like manner, circular opening 113, aligned with circular opening 111, is disposed in side wall 103 for receiving protrusion 87. As the radii of the circular openings 111 and 113 are somewhat larger than the radii of the protrusions, latch cam 8 is pivotable within the latch cam holder arrangement 10. Screw holes 121 and 131 are disposed on either side of opening 111, and screw holes 123 and 133 are disposed on opposite sides of opening 113. Stops 143 and 145 are included on the inner wall surface of said wall 101 to limit the pivoting motion of the latch cam 8 in the latch cam holder arrangement 10.

Hold-down spring 11 is mounted to overlie boss means 83 of latch cam 8, and push-up spring 12 is mounted to underlie the boss means 83 of the latch cam 8.

In assembling the door latch, bolt extension member 6 is coupled to bolt head 1 using the roll pin 7. The coupled bolt head and bolt extension member are then slid into latch housing 5 through the open end thereof such that bolt extension member 6 extends outwardly of the other end of the latch housing 5. The bolt head is then moved to its fully extended position, and side wall 91 of the extension housing 9 is coupled to the end wall of the latch housing 5.

The latch cam 8 is then assembled into latch cam holder arrangement 10 by inserting the latch cam 8 between side walls 101 and 103 such that protrusion 85 and 87 extend trough openings 111 and 113 respectively. Spring 11 is mounted between the side walls to overlie boss means 83.

The bolt head 1 is then pushed back into latch housing 5 into its fully retracted position. The assembled latch cam holder arrangement is then disposed on side wall 91 such that the engagement means 81 of latch cam 8 extends through one of the openings 64 or 65 in the top surface 63 of bolt extension member 6. Spring 10 is then mounted to underlie the boss means 83 of latch cam 8.

By rotating the boss means 83 in a counter-clockwise position, the bolt head 1 will be moved to its fully extended position. When the bolt head 1 is in its fully extended position, side wall 93 of extension housing 9 is coupled to the inner end of latch housing 5 to complete the door latch. In operation, when the latch cam 8 is pivoted in a clockwise direction, engagement means 81 will engage the right-hand edge of either opening 64 or 65 to push the bolt extension member 6, and therefore, bolt head 1, in a leftward direction to retract the bolt head 1 into latch housing 5. In a like manner, when the cam 8 is pivoted in a counter-clockwise direction, the engagement means 81 of cam 8 will engage the left-hand edge of either opening 64 or 65 to push the bolt extension member 6, and therefore bolt head 1, in a leftward direction to extend bolt head 1 out of latch housing 5.

It is noted that the particular shape of the engagement means will prevent unauthorized forcing of the bolt head 1 into or out of the latch housing 5. For example, considering FIG. 2, if the left-hand end of the bolt head 1 were pushed inwardly (in the right-hand direction) then the left-hand edge of opening 65 would engage surface 830 of engagement means 81 to slightly pivot cam 8 in a clockwise direction. However, after only a short distance, surface 870 of engagement means 81 would underlie the bottom surface of 63 so that further clockwise pivoting would be prohibited.

In a like manner, with the bolt head 1 in its fully retracted position, and the latch cam 8 pivoted to its full clockwise position, if a force is applied at the right-hand end of the bolt extension member 6, then the right-hand side of opening 65 would bear against surface 810 to slightly pivot latch cam 8 in a counter-clockwise direction. However, once again, after only a small amount of pivoting, surface 850 would underlie the bottom surface of 63 to prohibit further counter-clockwise pivoting.

As is well known in the art, the boss means 83 would be coupled to a latch moving means, for example, the tail piece of a door knob mounted on the side of the door, could extend into openings of cross 890 of the boss means 83. Thus, by rotating the knob, the bolt head 1 could be extended or retracted as required.

In considering the method of adjusting the backset distance in accordance with the illustrated embodiment of the invention, it is first pointed out, as seen in FIGS. 2 and 3, that the boss means 83 abuts only one or the other of arcs 932 or 934 of the cut-out 931. (In the same way, it will abut only one of the arcs 912 or 914 of the cut-out 911 in side wall 91.) To maintain the extension housing arrangement 9 in its assembled position, a first screw is mounted in the screw hole adjacent to the arc in which the boss means is disposed, and a second screw is mounted in the unoccupied arc position. The screws, of course, extend through respective aligned openings 121, 123 or 131, 133 of side walls 101 and 103.

To adjust the backset distance, the boss means is engaged, on either side thereof, by the fingers of a person or with a screw driver adjusting the backset. The boss means, and therefore the latch cam 8 are moved downwardly against the force of the spring 12 and then longitudinally until the boss means abuts the other one of the arcs. For example, to adjust from a 2¾" backset, (as in FIG. 2) to a 2⅜" backset (as in FIG. 3), the boss means is forced downwardly out of arc 932 so that it no longer abuts arc 932, and leftwardly so that it abuts arc 934 (as in FIG. 3). It will be noted that, when the cam and the latch cam holder arrangement are moved from their FIG. 2 position to their FIG. 3 position, the engagement means 81 of latch cam 8 is moved out of opening 65 in surface 63 into opening 64 in surface 63.

Thus, when the backset is a smaller distance, the latch cam 8 engages the bolt extension member 6 at a point closer to its left-hand end than when the backset is at a larger distance.

Although a particular embodiment has been described, this was for the purpose of illustrating, but not limiting, the invention. Various modifications, which will come readily to the mind of one skilled in the art, are within the scope of the invention as defined in the appended claims.

I claim:

1. A door latch having an adjustable backset distance, and comprising;

an elongated latch housing having a first end and a second end;

a bolt head slidably mounted in said latch housing for movement into and out of said latch housing through said first end thereof;

an elongated bolt extension member having one end thereof coupled to said bolt head, whereby said bolt head and said bolt extension member will move together, the other end of said bolt extension member extending out of said latch housing through said second end thereof;

said bolt extension member being U-shaped in cross-section and having a top surface which forms the bridge of the U;

first and second spaced openings in said top surface of said bolt extension member adjacent said other end thereof;

a latch cam having an engagement means at one end thereof and a circular boss means at the other end thereof;

an extension housing arrangement extending from said second end of said latch housing, said bolt extension member being slidably housed in said extension housing;

a latch cam holder arrangement movably housed in said extension housing to be movable from a first position, corresponding to a first backset distance, to a second position, corresponding to a second backset distance, whereby to adjust said backset distance;

said latch cam being pivotally held in said latch cam holder arrangement for pivoting about the center of said circular boss means;

wherein, in said first position, said engagement means of said latch cam extends through said first opening in said top surface of said bolt extension member, and in said second position, said engagement means of said latch cam extends through said second opening in said top surface of said bolt extension member;

whereby, when the latch cam is pivoted in one direction, it engages the bolt extension member and causes it to slide in said extension housing arrangement in said one direction to extend said bolt head out of said latch housing, and, when the latch cam is pivoted in a second direction, opposite to said first direction, it engages said bolt extension and causes it to slide in said extension housing arrangement in said second direction to retract said bolt head into said latch housing.

2. A door latch as defined in claim 1 wherein said latch cam holder arrangement comprises:

a first side wall and a spaced second side wall said side walls being joined, at respective edges thereof, by a first end wall and a second end wall;

aligned first and second openings in said first side wall and said second side wall respectively;

said boss means comprising a circular protrusion on each surface thereof;

a respective protrusion extending through a respective one of said aligned first and second openings;

said latch cam being mounted between said first side wall and said second side wall of said latch cam holder arrangement;

whereby, said latch cam is pivotally housed in said latch cam holder arrangement.

3. A door latch as defined in claim 2 and further including a hold down spring mounted to overlie said boss means in said latch cam holder arrangement to thereby bias said latch cam downwardly.

4. A door latch as defined in claim 1 wherein said extension housing arrangement comprises:

a first side wall having a cut-out portion with a first arc, at a first position corresponding to one backset distance, and a spaced second arc at a second position corresponding to a second backset distance, said arcs having equal radii equal to the radii of said circular protrusions;

a second side wall having a cut-out portion aligned with the cut-out portion of said first side wall, said cut-out portion of said second side wall comprising a first arc, aligned with the first arc of said first side wall, and a spaced second arc, aligned with the second arc of said first side wall;

hold up spring means underlying said latch cam to bias said latch cam upwardly;

said latch cam holder arrangement being mounted between the first and second side walls of said extension housing arrangement;

the circular protrusions of said boss means abutting one of the arcs in one of said side walls of said extension housing and in the aligned arc in the other side wall of said extension housing;

whereby, to change the backset distance, said boss means of said latch cam is moved, against the force of said hold up spring, so that the protrusions abut the second one of said arcs in said first side wall of said extension housing and the aligned second one of said arcs in said second side wall of said extension housing.

* * * * *